US006181314B1

(12) United States Patent
Nakajima et al.

(10) Patent No.: US 6,181,314 B1
(45) Date of Patent: Jan. 30, 2001

(54) LIQUID CRYSTAL DISPLAY DEVICE

(75) Inventors: Yoshiharu Nakajima; Toshikazu Maekawa, both of Kanagawa (JP)

(73) Assignee: Sony Corporation, Tokyo (JP)

( * ) Notice: Under 35 U.S.C. 154(b), the term of this patent shall be extended for 0 days.

(21) Appl. No.: 09/141,314

(22) Filed: Aug. 27, 1998

(30) Foreign Application Priority Data

Aug. 29, 1997 (JP) ..... 9-233517

(51) Int. Cl.[7] ..... G09G 3/36
(52) U.S. Cl. ..... 345/100; 345/98
(58) Field of Search ..... 345/100, 98

(56) References Cited

U.S. PATENT DOCUMENTS

| | | | | |
|---|---|---|---|---|
| 4,697,154 | * | 9/1987 | Kousaka et al. | 330/277 |
| 5,061,920 | * | 10/1991 | Nelson | 340/784 |
| 5,103,218 | * | 4/1992 | Takeda | 345/100 |
| 5,196,738 | * | 3/1993 | Takahara et al. | 345/89 |
| 5,739,805 | * | 4/1998 | Dingwall | 345/100 |
| 5,900,856 | * | 5/1999 | Iino et al. | 345/100 |
| 5,907,314 | * | 11/1999 | Negishi et al. | 345/100 |
| 5,977,940 | * | 11/1999 | Akiyama et al. | 345/94 |
| 5,995,072 | * | 11/1999 | Nakajima | 345/87 |

FOREIGN PATENT DOCUMENTS

| | | |
|---|---|---|
| 0510696 A1 | 10/1992 | (EP) . |
| 0597315 A2 | 5/1994 | (EP) . |
| 0657863 | 6/1995 | (EP) . |

OTHER PUBLICATIONS

European Search Report dated Apr. 20, 2000.
"P–14: Low Output Offset, 8 bit Signal Drivers for XGA/SVGA TFT–LCDS"; I Minamizaki H et al; SID's International Display Research Conference; vol. Conf. 16, 1996, pp. 247–250.

* cited by examiner

*Primary Examiner*—Matthew Luu
*Assistant Examiner*—Anthony J. Blackman
(74) *Attorney, Agent, or Firm*—Ronald P. Kananen; Rader, Fishman & Grauer

(57) ABSTRACT

A liquid crystal display device having output buffers corresponding to column lines, and comprising analog switches provided between output ends of the output buffers and the column lines respectively, and a switch controller for on-off controlling the analog switches. A DA converter is provided in the preceding stage of the output buffers, and the switch controller turns off the analog switches during a DA conversion period of the DA converter or during a precharge period prior to DA conversion, and turns on the analog switches during a predetermined period other than such periods. The output buffers are disconnected from or connected to the column lines when the analog switches are turned off or turned on. Therefore the output circuit can be separated from a capacitive load by disconnecting the output buffers from the column lines through turning off the analog switches during a DA conversion period of a DA converter provided in the preceding stage of the output circuit or during a precharge period prior to DA conversion, hence preventing increase of the output current of each output buffer while ensuring sufficient change of the signal potential.

15 Claims, 6 Drawing Sheets

LIQUID CRYSTAL DISPLAY DEVICE

BACKGROUND OF THE INVENTION

The present invention relates to a liquid crystal display device, and more particularly to an output circuit relative to column lines of a column driver in an active matrix liquid crystal display device.

FIG. 7 shows an exemplary structure of an active matrix liquid crystal display device. In this diagram, a liquid crystal panel 102 is composed of liquid crystal cells (pixels) 101 arrayed to form a two-dimensional matrix, and a vertical (row) driver 103 for row selection and a horizontal (column) driver (column line driving circuit) 104 for column selection are provided in the periphery of the liquid crystal panel 102.

As shown in FIG. 8, the horizontal driver 104 comprises a shift register 111 having a plurality of stages corresponding to the number n of column lines, a shift register controller 112 for controlling the shift register 111, a sampling circuit 113 for sampling data on a data bus line in synchronism with sampling pulses outputted successively from the shift register 111, a latch circuit 114 for holding the sampled data during one horizontal period, a DA converter 115 for converting the latch data into analog signal, and an output circuit 118 consisting of n output buffers 117-1–117-n for driving the column lines 116-1–116-n respectively.

In the related art output circuit of the above configuration, output ends of the output buffers 117-1–117-n are connected directly to the column lines 116-1–116-n, so that no problem is raised in particular if the output buffers 117-1–117-n structurally have sufficient driving capability with regard to both input and output currents. However, there arise some problems in case the output buffers 117-1–117-n are composed of source follower circuits for example and have sufficient driving capability merely in one direction.

If, even after charging a great load, the output ends of the output buffers 117-1–117-n are still connected to the load until being reset to the initial state, then it follows that the output circuit needs to have a complete characteristic or a sufficient time for discharging the load. For example, in case each of the output buffers 117-1–117-n consists of a source follower circuit, a power supply for the source follower circuit is required to furnish a current necessary for discharging the capacitive load, whereby the resultant power consumption is steadily rendered large.

Increasing the direct current value of the source follower circuit brings about reduction of the dynamic range, dimensional increase of the circuit area, and increase of output variations at the time of offset cancellation. This disadvantage raises an extremely serious problem when the output buffers 117-1–117-n consist of source follower circuits each composed of a polysilicon TFT (thin film transistor), since the threshold voltage Vth of a polysilicon TFT is high and variation in such threshold voltage Vth is large.

Due to the reasons mentioned, it has been difficult heretofore to constitute the output circuit by the use of a unipolar output buffer. Similarly, even in the use of an output buffer having bidirectional current output capability like a push-pull buffer, there may occur a case where an unnecessary capacitive load is charged or discharged during the DA conversion period of the DA converter 115 and also during its precharge period. In such a case, therefore, some unnecessary power is consumed.

SUMMARY OF THE INVENTION

It is an object of the present invention to provide an improved output circuit in a liquid crystal display device where a power consumption is low and output potential variations are minimized.

According to one aspect of the present invention, there is provided a liquid crystal display device having output buffers corresponding to column lines. This display device comprises analog switches provided between output ends of the output buffers and the column lines respectively, and a switch controller for on-off controlling the analog switches. A DA converter is provided in the preceding stage of the output buffers, and the switch controller turns off the analog switches during a DA conversion period of the DA converter or during a precharge period prior to DA conversion, and turns on the analog switches during a predetermined period other than such periods.

In the liquid crystal display device of the above circuit configuration, the output buffers are disconnected from or connected to the column lines when the analog switches are turned off or turned on. Therefore, the output circuit can be separated from a capacitive load by disconnecting the output buffers from the column lines through turning off the analog switches during a DA conversion period of a DA converter provided in the preceding stage of the output circuit or during a precharge period prior to DA conversion, hence preventing increase of the output current of each output buffer while ensuring sufficient change of the signal potential.

According to another aspect of the present invention, there is provided a liquid crystal display device having a horizontal driver and a vertical driver. The horizontal driver comprises a shift register having a plurality of stages equal in number to columns; a shift register controller for controlling the shift register; a sampling circuit for sampling data on a data bus line in synchronism with sampling pulses outputted successively from the shift register; a latch circuit for holding the sampled data during one horizontal period; a DA converter for converting into analog signal the data held by the latch circuit; output buffers for driving column lines; and analog switches provided between the column lines and the output buffers. In this structure, the analog switches are on-off controlled by a switch controller.

The above and other features and advantages of the present invention will become apparent from the following description which will be given with reference to the illustrative accompanying drawings.

DESCRIPTION OF THE PREFERRED EMBODIMENTS

Figure 1:
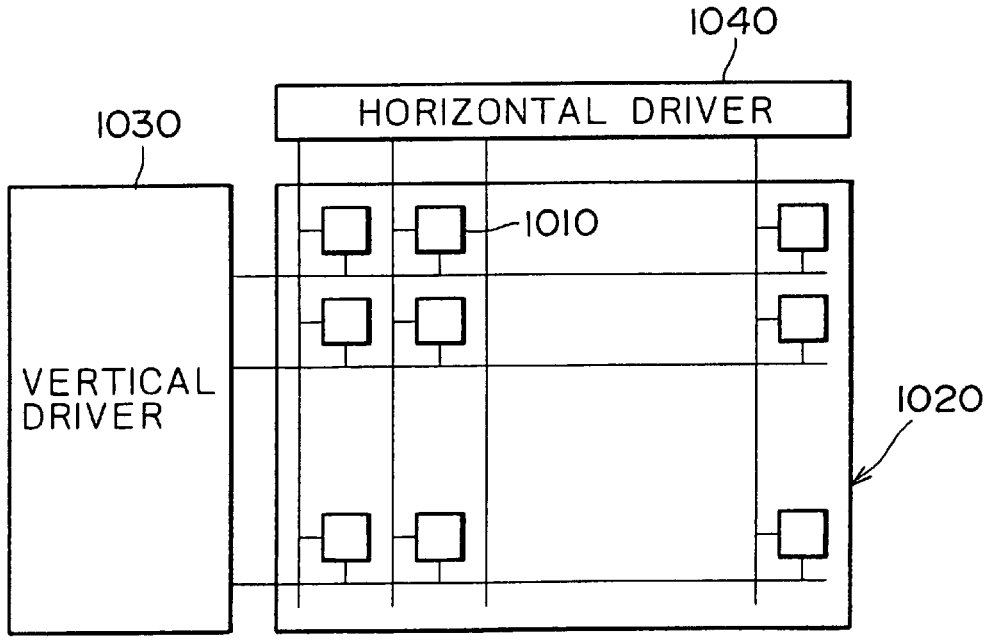
FIG. 1 schematically shows the structure of a liquid crystal display device according to the present invention.

Hereinafter some preferred embodiments of the present invention will be described in detail with reference to the accompanying drawings. FIG. 1 schematically shows the structure of a liquid crystal display device according to the present invention, and FIG. 2 is a block diagram showing an embodiment of the present invention applied to a column driving circuit (horizontal driver) in a liquid crystal display device.

FIG. 1 shows an exemplary structure of an active matrix liquid crystal display device. In this diagram, a liquid crystal panel 1020 is composed of liquid crystal cells (pixels) 1010 arrayed to form a two-dimensional matrix, and a vertical (row) driver 1030 for row selection and a horizontal (column) driver (column line driving circuit) 1040 for column selection are provided in the periphery of the liquid crystal panel 1020.

Figure 2:
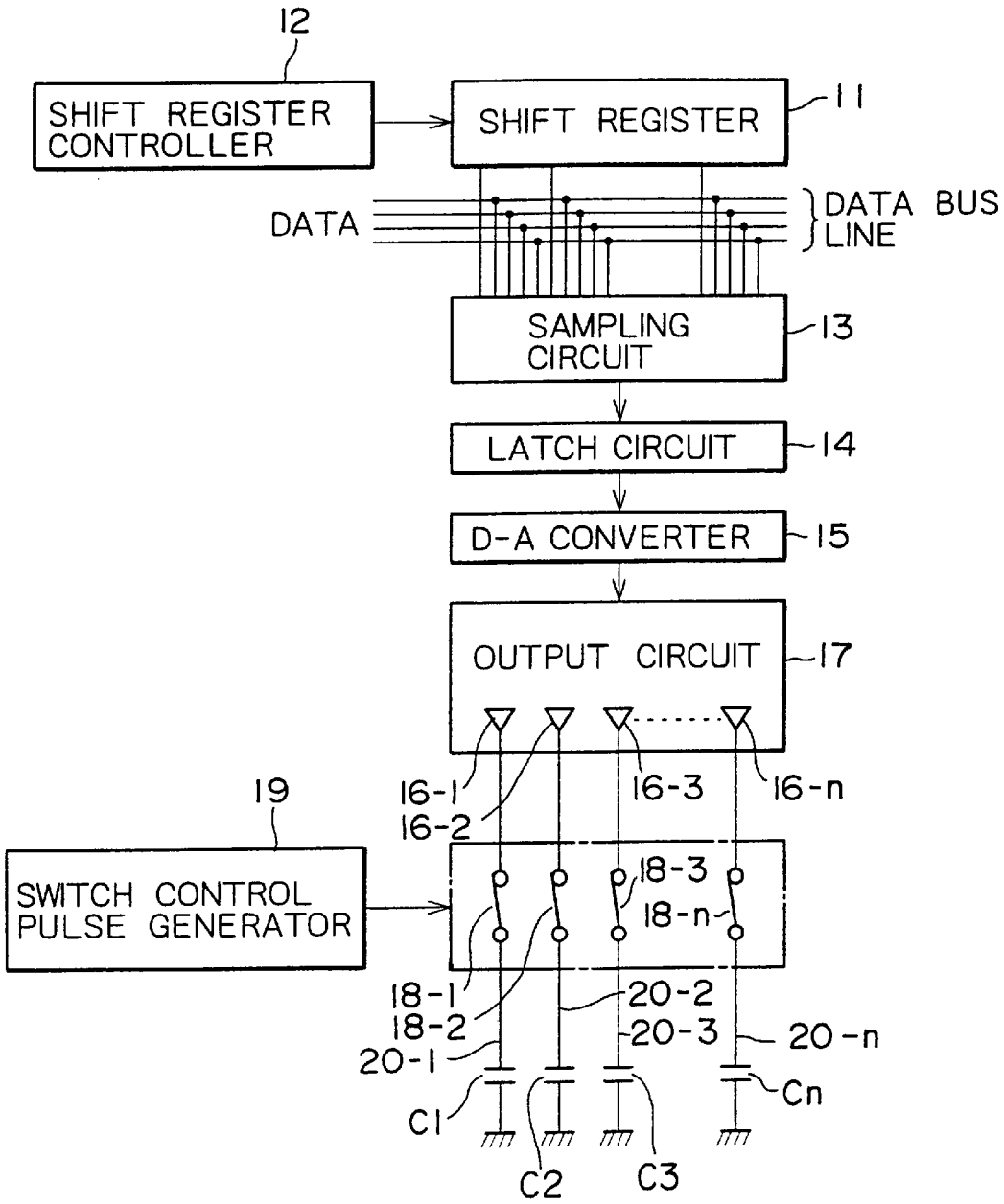
FIG. 2 is a block diagram showing an embodiment of the present invention.

As obvious from FIG. 2, the column driving circuit according to the present invention comprises a shift register 11 having a plurality of stages corresponding to the number n of column lines, a shift register controller 12 for controlling the shift register 11, a sampling circuit 13 for sampling data on a data bus line in synchronism with sampling pulses outputted successively from the shift register 11, a latch circuit 14 for holding and latching the sampled data during one horizontal period, a DA converter 15 for converting the latched data into analog signal, an output circuit 17 consisting of n output buffers 16-1–16-n for driving the column lines respectively, n analog switches 18-1–18-n, and a switch control pulse generator 19.

Ends of the analog switches 18-1–18-n on one side thereof are connected to the output ends of the output buffers 16-1–16-n respectively, and the column lines 20-1–20-n are connected to the other ends of the analog switches 18-1–18-n. These column lines 20-1–20-n have capacitive loads Cl–Cn respectively. The switch control pulse generator 19 generates switch control pulses for on-off controlling the analog switches 18-1–18-n.

More specifically, the switch control pulse generator 19 turns off the analog switches 18-1–18-n during a DA conversion period of the DA converter 15 or during a precharge period prior to DA conversion to thereby disconnect the output buffers 16-1–16-n from the column lines 20-1–20-n respectively, and turns on the analog switches 18-1–18-n only during a predetermined period to thereby connect the output buffers 16-1–16-n to the column lines 20-1–20-n respectively.

Figure 3:
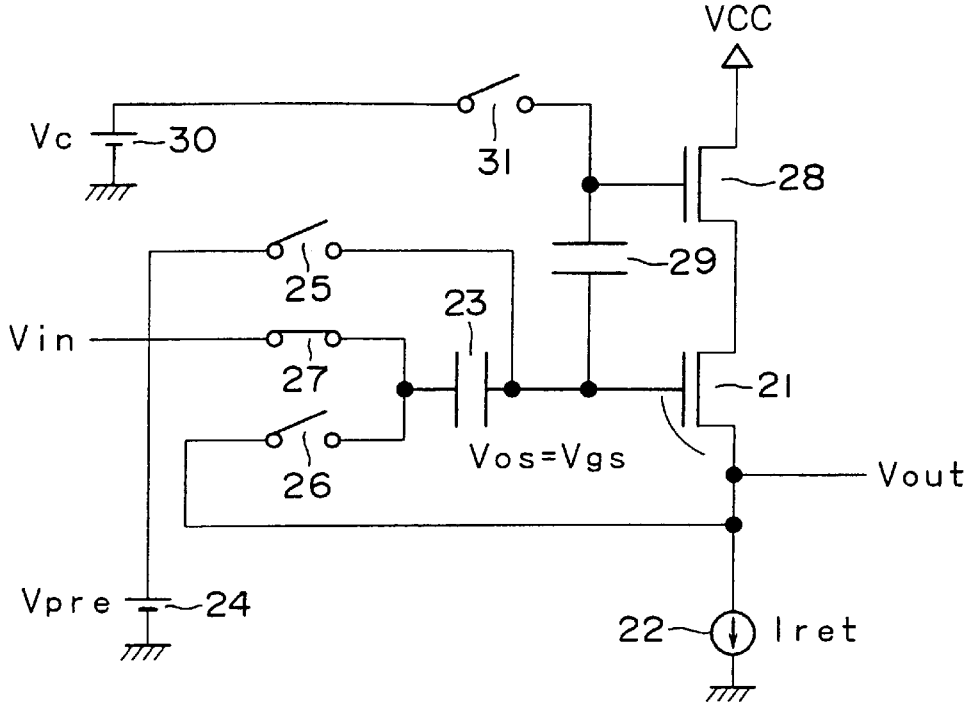
FIG. 3 is a circuit diagram showing an exemplary configuration of an output buffer using a source follower circuit.

FIG. 3 shows an exemplary structure of the output buffers 16-1–16-n each consisting of a source follower circuit. In this diagram, one end of a first capacitor 23 is connected to a gate of an NMOS source follower transistor 21, and a first analog switch 25 is connected between the gate of the source follower transistor 21 and a precharge power supply 24. Further a second analog switch 26 is connected between the other end of the first capacitor 23 and the source of the source follower transistor 21, and a third analog switch 27 is connected between the other end of the first capacitor 23 and a signal source (Vin).

An NMOS transistor 28 is cascode-connected to the drain of the source follower transistor 21, and a second capacitor 29 is connected between the gate of the source follower transistor 21 and the gate of the cascode transistor 28. And further a fourth analog switch 31 is connected between the gate of the cascode transistor 28 and a power supply 30 of a predetermined voltage Vc. The voltage Vc of the power supply 30 is set to a value shifted by a certain quantity from a precharge voltage Vpre of the source follower transistor 21. The shift quantity is calculated on the basis of saturation conditions of the source follower transistor 21 and the cascode transistor 28.

Figure 4:
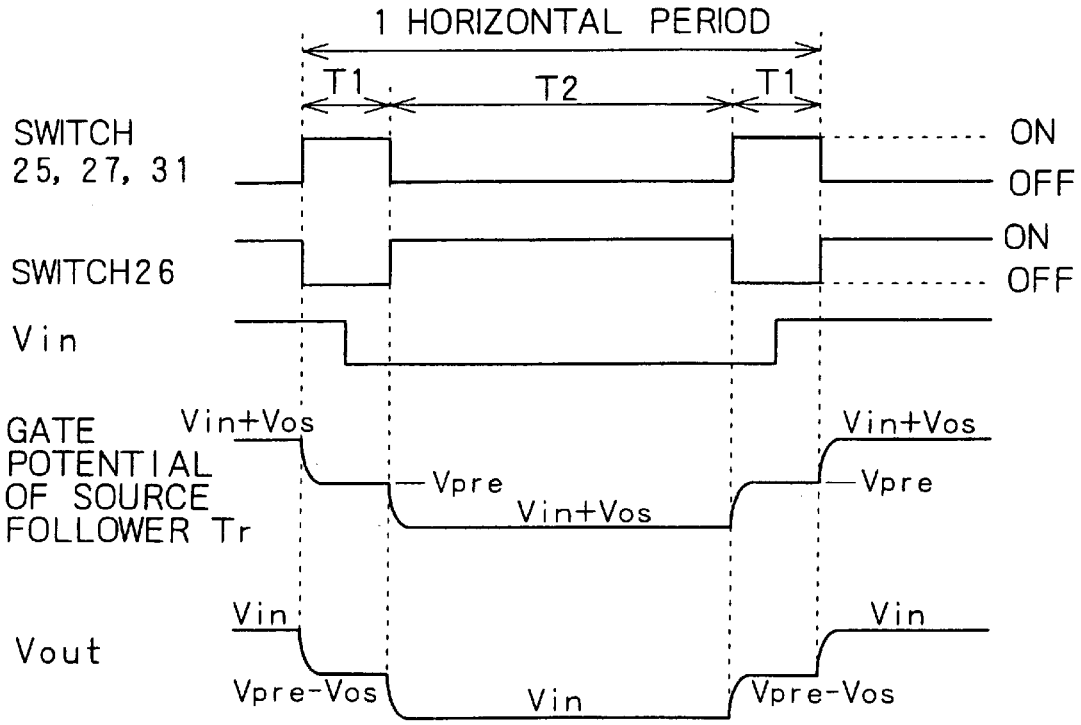
FIG. 4 is a timing chart of signals for explaining the operation of the circuit in FIG. 2.

Next, the operation of the source follower circuit having the above configuration will be described below with reference to a signal timing chart of FIG. 4.

First in a precharge period T1, the first and second analog switches 25 and 26 are turned on while the third analog switch 27 is turned off, whereby a predetermined precharge voltage Vpre is applied from the precharge power supply 24 to the gate of the source follower transistor 21 via the first analog switch 25. In this case, a charge corresponding to the offset Vos (=Vgs) is stored in the first capacitor 23 connected between the gate and source of the source follower transistor 21.

Thereafter in an output period T2, the first and second switches 25 and 26 are turned off while the third analog switch 27 is turned on, whereby the other end of the first capacitor 23 (source side of the source follower transistor 21) is connected again to the input signal Vin (signal source side) while the gate of the source follower transistor 21 is disconnected from the precharge power supply 24. In this case, the gate potential of the source follower transistor 21 is changed to Vin+Vos.

Consequently, despite generation of an offset Vos' corresponding to the gate-source voltage Vgs of the source follower transistor 21, the offset is canceled (i.e., Vos−Vos') since Vos'=Vos, so that the output potential Vout in the output period T2 is rendered substantially equal to the input potential Vin. This is equivalent to that the output potential variation derived from the transistor characteristic variation can be reduced.

In a precharge period, the gate of the cascode transistor 28 is precharged to the voltage Vc by turning on the fourth analog switch 31 as well as the first and second analog switches 25 and 26. Subsequently in an output period, the gate of the cascode transistor 28 is disconnected from the power supply 30 by turning off the fourth analog switch 31.

The gate potential of the cascode transistor 28 can be set higher than the supply voltage VCC due to such on-off action of the fourth analog switch 31, hence raising the drain voltage of the source follower transistor 21. Therefore, even if a polysilicon TFT or the like having a high threshold voltage Vth with large variation is used as the source follower transistor 21 to form a source follower circuit, the drain voltage range of the transistor 21 is widened to consequently achieve extension of the output dynamic range.

In the above circuit configuration, precharging the first capacitor 23 can be performed by the precharge power supply 24 which is independent of the signal source, so that it is not necessary to diminish the output impedance of the signal source to an extremely small value. And the resultant merit attainable therefrom is remarkably great when the source follower circuit is used as an output circuit of a reference voltage selection type DA converter in the horizontal driver of a liquid crystal display device. That is, the width of its reference voltage line can be narrowed to eventually realize dimensional reduction of the whole circuit.

The advantages attainable due to such circuit operation are effective particularly when the source follower circuit is composed of a polysilicon TFT. The reason is as follows. Since a polysilicon TFT has no substrate potential, there is no substrate bias effect. Accordingly, when the output voltage (source potential of the source follower transistor 21) is changed as a result of any change in the input voltage (input potential of the source follower transistor 21), the threshold voltage Vth remains unchanged so that offset cancellation is performed with high accuracy. Further because of nonexistence of a substrate potential, the parasitic capacitance on one-end side of the first analog switch 25 (i.e., base side of the source follower transistor 21) is rendered small so that, when the base potential of the source follower transistor 21 is changed, the offset charge stored in the first capacitor 23 is not released with ease.

Figure 5:
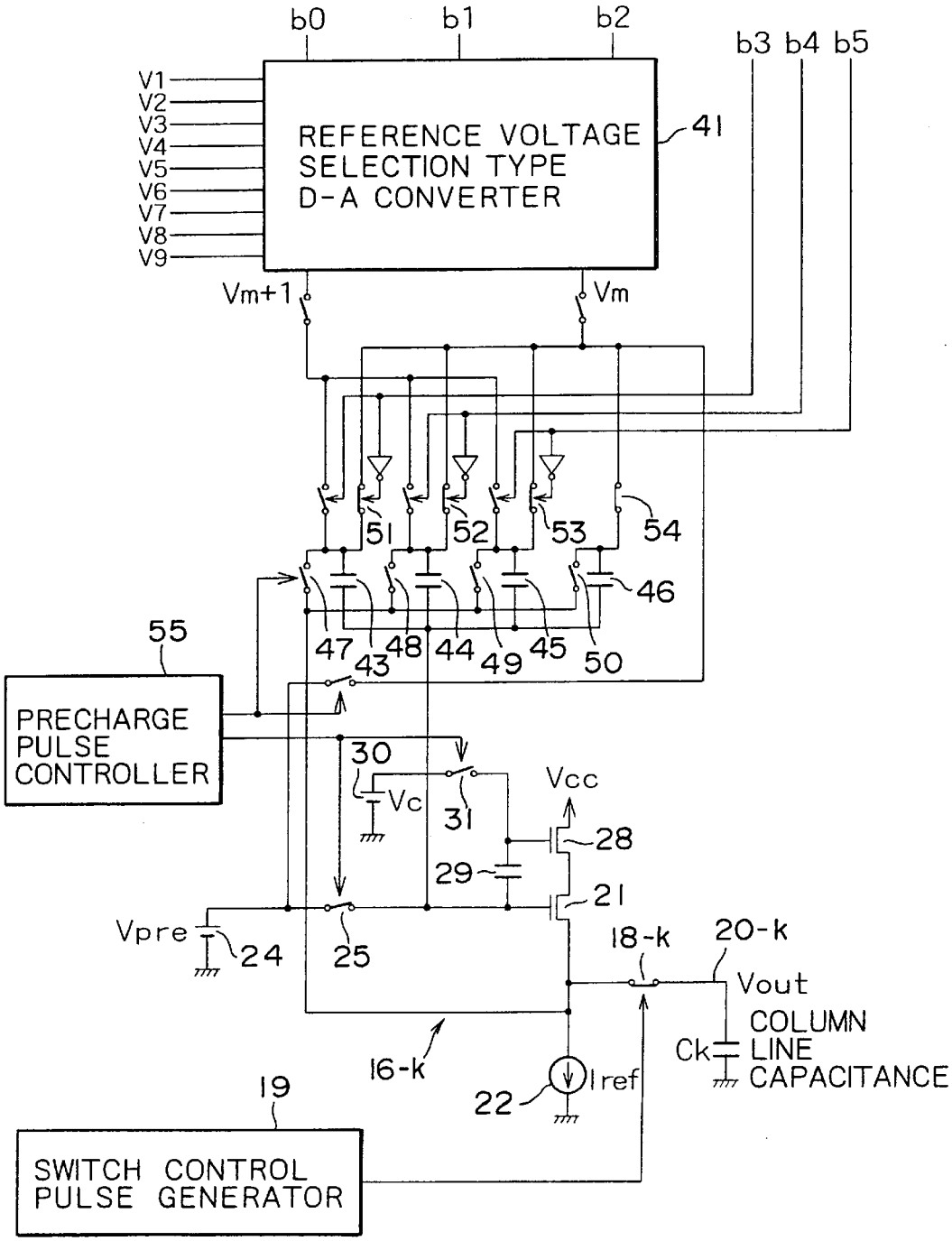
FIG. 5 is a circuit diagram showing a concrete example to which the present invention is applied.

FIG. 5 shows a concrete configuration where a source follower circuit having the above-described offset cancel structure is employed as an output circuit in a column driver. In FIG. 5, there is shown a circuit configuration relative merely to one column line 20-k alone, and any circuit components corresponding to those in FIG. 3 are denoted by like reference numerals or symbols.

In this example, the aforementioned DA converter 15 provided in the preceding stage of the output circuit 17 shown in FIG. 2 comprises a reference voltage selection type DA converter 41 for three high-order bits b0–b2 and a switched capacitor array type DA converter 42 for three low-order bits b3–b5. In this configuration, capacitors of the switched capacitor array type DA converter 42 serve also as the offset storage capacitor 23 of the source follower circuit in the foregoing configuration.

More specifically, the combined capacitance of four capacitors 43, 44, 45 and 46, which are provided correspondingly to three low-order bits b3–b5 and each of which is connected at one end thereof to the gate of the source follower transistor 21, corresponds to the offset storage capacitor 23. The capacitance values of such four capacitors 43, 44, 45, 46 are set to a ratio of 4Co:2Co: Co:Co.

Four analog switches 47–50, which are connected between the other ends of the capacitors 43–46 and the source of the source follower transistor 21, correspond to the second analog switch 26, and four analog switches 51–54, which are connected between the other ends of the capacitors 43–46 and a signal source, correspond to the third analog switch 26. The analog switches 25, 47–50 and so forth are on-off controlled by a precharge pulse controller 55.

Figure 6:
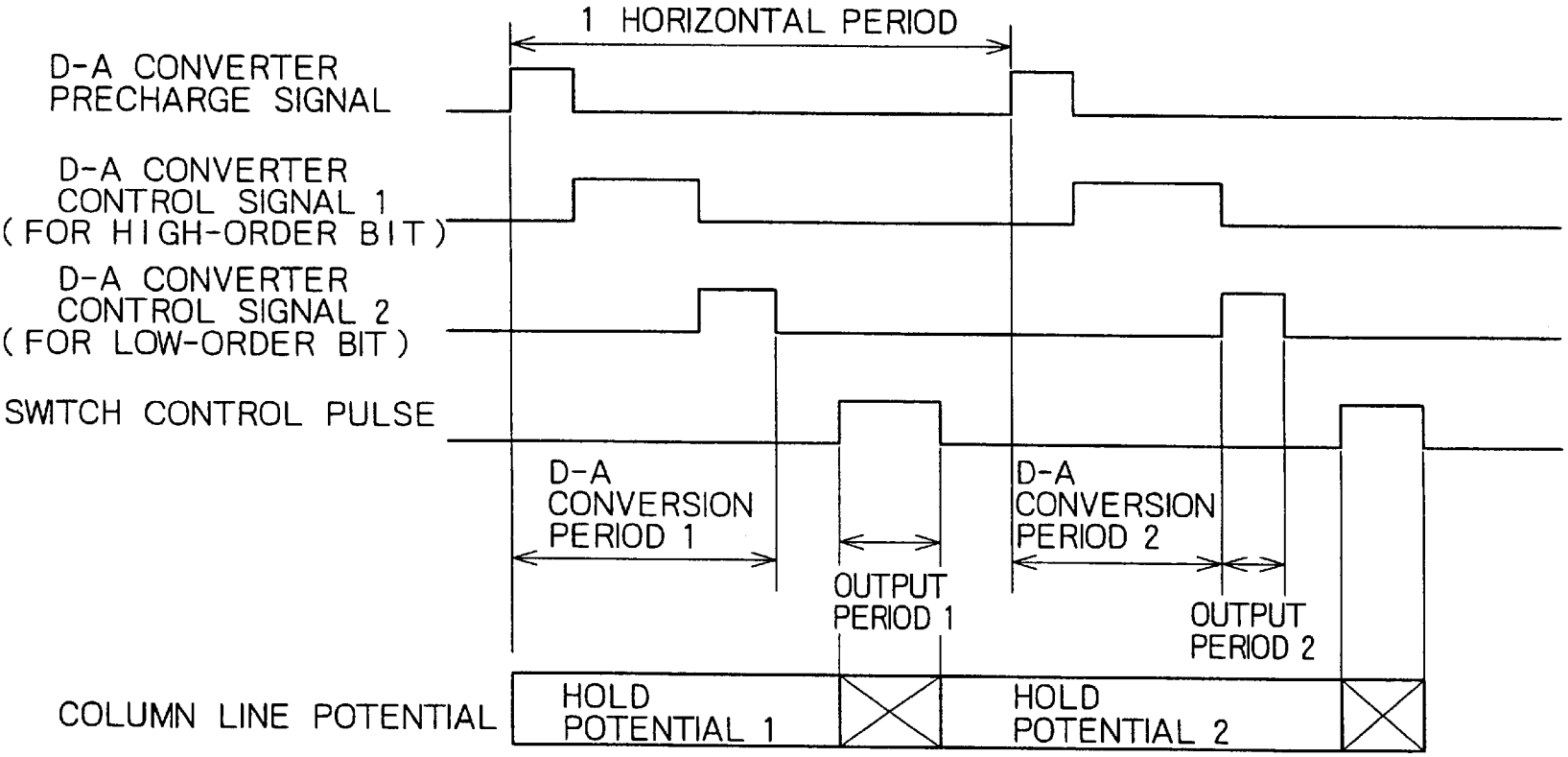
FIG. 6 is a timing chart of signals for explaining the operation of the present invention.
Figure 7:
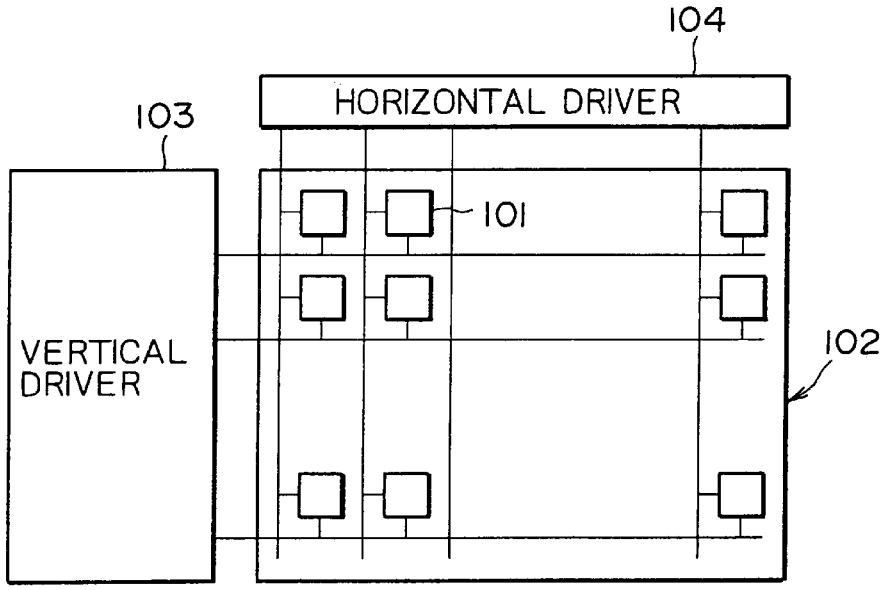
FIG. 7 is a schematic structural diagram showing an example of an active matrix liquid crystal display device.
Figure 8:
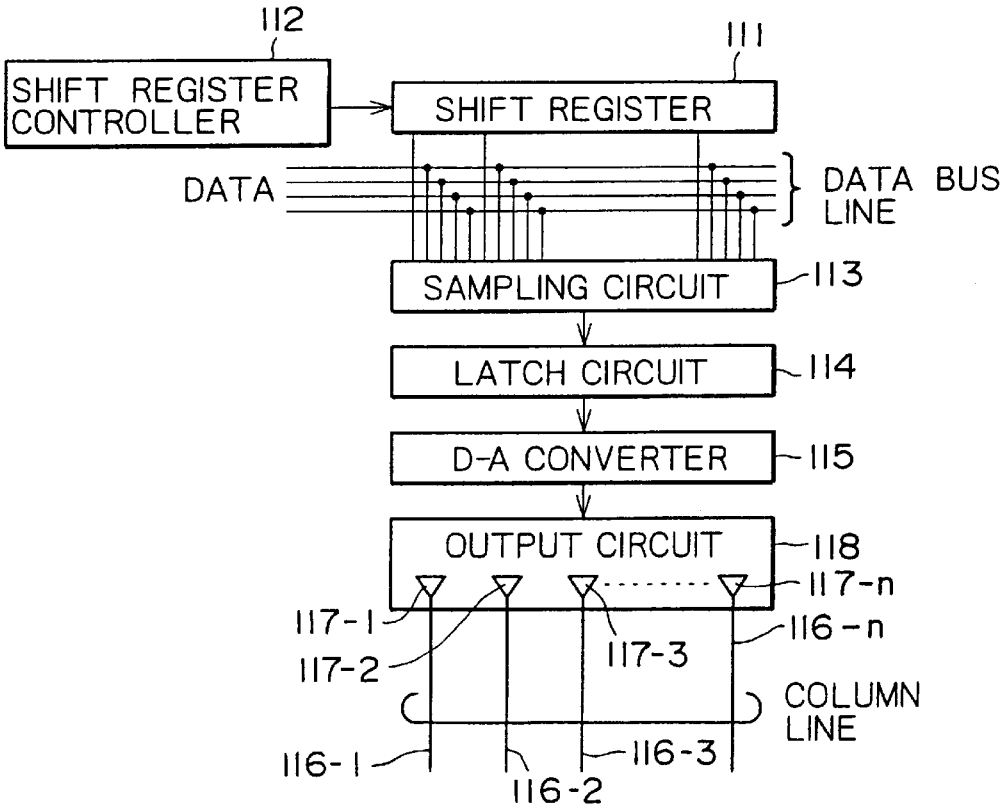
FIG. 8 is a block diagram showing an exemplary structure of a horizontal driver (column driving circuit).

Meanwhile an analog switch 18-k provided between the output end of an output buffer 16-k and a column line 20-k is on-off controlled by a switch control pulse generated from a switch control pulse generator 19. More concretely, as shown in a signal timing chart of FIG. 6, the analog switch 18-k is turned off during a precharge period and a DA conversion period, but is turned on only during a predetermined period other than such periods.

As described, a source follower circuit having an offset cancel structure is employed as each of the output buffers 16-1–16-n in the column driver of the liquid crystal display device with the switched capacitor array type DA converter 14 for three low-order bits b3–b5, whereby the offset storage capacitor 23 and the capacitors of the switched capacitor array type DA converter 42 can be used in common to consequently minimize the number of additionally required circuit elements, hence enhancing the efficiency.

In general, the output current of the source follower circuit shown in FIG. 5 can be obtained without any limit at a signal rise time, but is limited at a signal fall time to a maximum of the current Iref of a power supply 22. Therefore, if a large output load is connected at a signal fall time, it is impossible to change the signal sufficiently. For achieving sufficient change of the signal, a current Iref of a great value is required.

However, the present invention is so contrived that, when the signal potential is widely decreased during a precharge period or the like, the analog switch 18-k is turned off during this period to disconnect the output buffer 16-k from the capacitive load Ck, whereby the output current of the source follower circuit is not increased to consequently enable sufficient change of the signal potential. In other words, a current Iref of merely a small value is enough in constituting a desired output circuit. The output period, during which the analog switch 18-k is turned on, may be set to a predetermined one other than the precharge period and the DA conversion period.

Forming the output circuit with a small current Iref brings about an advantage of minimizing variations in the output potential. The reason will be described below.

Generally the offset potential of a source follower circuit (gate-source voltage of source follower transistor 21) Vgs is expressed as follows.

$$Vgs=Vth+\sqrt{(Iref/k)}$$

where $k=0.5\times\mu\times Cox\times W/L$. In this equation, k is a constant; and Cox, W and L denote the oxide film capacitance, the gate length and the gate width of the transistor, respectively.

Accordingly, the offset potential Vgs is raised with increase of the current Iref. In general, this brings about a result of narrowing the output dynamic range of the circuit. In other words, the transistor size needs to be enlarged for ensuring a desired dynamic range. If the current Iref is small in value, the transistor size can be diminished to consequently realize dimensional reduction of the circuit.

When the current Iref is great in value, the variation extent of the offset potential Vgs to the variation of the constant k (i.e., device characteristic variation of the transistor) becomes high. Such relationship remains fundamentally unchanged even in such offset cancel structure shown in FIG. 3 (FIG. 5). Therefore, decrease of the current Iref causes reduction of the output variation.

The source follower circuit having the above-described offset cancel structure is rendered useful particularly when the column driving circuit (horizontal driver) is composed of a polysilicon TFT integrally with the liquid crystal panel. The reasons are as as follows.

(1) In polysilicon TFT, variation of the constant k is extremely large.

(2) The gate bias effect and the parasitic capacitance are little to consequently enable easy production of a source follower circuit having an offset cancel structure.

Thus, according to the present invention relative to an output circuit in a liquid crystal display device having a plurality of output buffers corresponding to column lines respectively, analog switches are provided between output ends of the output buffers and the column lines, and the analog switches are on-off controlled in such a manner that the output buffers and the column lines are mutually disconnected in an off-state of the analog switches to thereby separate the output circuit from the capacitive load, hence avoiding increase of the output current of the output buffers. Therefore, it becomes possible to easily constitute an improved system which charges the column line loads by the unidirectional current buffers, with some advantages of realizing a lower power consumption, a dimensional reduction of the circuit, a wider dynamic range, and decrease of the output potential variation.

Although the present invention has been described hereinabove with reference to some preferred embodiments thereof, it is to be understood that the invention is not limited to such embodiments alone, and a variety of other changes and modifications will be apparent to those skilled in the art without departing from the spirit of the invention.

The scope of the invention, therefore, is to be determined solely by the appended claims.

What is claimed is:

1. A liquid crystal display device having output buffers corresponding to column lines, comprising:

analog switches provided between output ends of said output buffers and said column lines respectively; and a switch controller for on-off controlling said analog switches, wherein each of said output buffers includes a source follower circuit which comprises: a first capacitor whose one end is connected to a gate of a source follower transistor; a first analog switch connected between the gate of said source follower transistor and a precharge power supply; a second analog switch connected between the other end of said first capacitor and the source of said source follower transistor, and interlocked with said first analog switch; a third analog switch connected between the other end of said first capacitor and a signal source, and actuated inversely to the on-off action of said first and second analog switches.

2. The liquid crystal display device according to claim 1, wherein a DA converter is provided in the preceding stage of said output buffers, and said switch controller turns off said analog switches during a DA conversion period of said DA converter or during a precharge period prior to DA conversion, and turns on said analog switches during another predetermined period.

3. The liquid crystal display device according to claim 1, wherein said follower circuit further comprises: a cascode transistor cascode-connected to the drain side of said source follower transistor; a second capacitor connected between the gate of said source follower transistor and the gate of said cascode transistor; and a fourth analog switch connected between the gate of said cascode transistor and a predetermined power supply, and interlocked with said first and second analog switches.

4. The liquid crystal display device according to claim 2, wherein each of said output buffers consists of a source follower circuit which comprises: a first capacitor whose one end is connected to a gate of a source follower transistor; a first analog switch connected between the gate of said source follower transistor and a precharge power supply; a second analog switch connected between the other end of said first capacitor and the source of said source follower transistor, and interlocked with said first analog switch; a third analog switch connected between the other end of said first capacitor and a signal source, and actuated inversely to the on-off action of said first and second analog switches; a cascode transistor cascode-connected to the drain side of said source follower transistor; a second capacitor connected between the gate of said source follower transistor and the gate of said cascode transistor; and a fourth analog switch connected between the gate of said cascode transistor and a predetermined power supply, and interlocked with said first and second analog switches.

5. The liquid crystal display device according to claim 4, wherein said DA converter consists of a reference voltage selection type DA converter and a switched capacitor array type DA converter, and capacitors of said switched capacitor array type DA converter are used also as said first capacitors.

6. The liquid crystal display device according to claim 3, wherein said source follower circuit is composed of a polysilicon thin film transistor.

7. The liquid crystal display device according to claim 4, wherein said source follower circuit is composed of a polysilicon thin film transistor.

8. The liquid crystal display device according to claim 5, wherein said source follower circuit is composed of a polysilicon thin film transistor.

9. A liquid crystal display device having a horizontal driver and a vertical driver, said horizontal driver comprising:

a shift register having a plurality of stages equal in number to columns;

a shift register controller for controlling said shift register;

a sampling circuit for sampling data on a data bus line in synchronism with sampling pulses outputted successively from said shift register;

a latch circuit for sampling data on a data during one horizontal period;

a DA converter for converting into analog signal the data held by said latch circuit;

output buffers for driving column lines, said output buffers each including a source follower circuit;

analog switches provided between said column lines and said output buffers;

wherein said analog switches are on-off controlled by a switch controller; and wherein said source follower circuit comprises:

a first capacitor whose one end is connected to a gate of a source follower transistor; a first analog switch connected between the gate of said source follower transistor and a precharge power supply; a second analog switch connected between the other end of said first capacitor and the source of said source follower transistor, and interlocked with said first analog switch; a third analog switch connected between the other end of said first capacitor and a signal source, and actuated inversely to the on-off action of said first and second analog switches; a cascode transistor cascode-connected to the drain side of said source follower transistor; a second capacitor connected between the gate of said source follower transistor and the gate of said cascode transistor; and a fourth analog switch connected between the gate of said cascode transistor and a predetermined power supply, and interlocked with said first and second analog switches.

10. The liquid crystal display device according to claim 9, wherein said switch controller turns off said analog switches during a DA conversion period of said DA converter or during a precharge period prior to DA conversion, and turns on said analog switches during another predetermined period.

11. The liquid crystal display device according to claim 10, wherein each of said output buffers consists of a source follower circuit which comprises: a first capacitor whose one end is connected to a gate of a source follower transistor; a first analog switch connected between the gate of said source follower transistor and a precharge power supply; a second analog switch connected between the other end of said first capacitor and the source of said source follower transistor, and interlocked with said first analog switch; a third analog switch connected between the other end of said first capacitor and a signal source, and actuated inversely to the on-off action of said first and second analog switches; a cascode transistor cascode-connected to the drain side of said source follower transistor; a second capacitor connected between the gate of said source follower transistor and the gate of said cascode transistor; and a fourth analog switch connected between the gate of said cascode transistor and a predetermined power supply, and interlocked with said first and second analog switches.

12. The liquid crystal display device according to claim 11, wherein said DA converter consists of a reference voltage selection type DA converter and a switched capacitor array type DA converter, and capacitors of said switched capacitor array type DA converter are used also as said first capacitors.

13. The liquid crystal display device according to claim 9, wherein said source follower circuit is composed of a polysilicon thin film transistor.

14. The liquid crystal display device according to claim 11, wherein said source follower circuit is composed of a polysilicon thin film transistor.

15. The liquid crystal display device according to claim 14, wherein said source follower circuit is composed of a polysilicon thin film transistor.

* * * * *